US012766660B2

(12) United States Patent
Givot et al.

(10) Patent No.: US 12,766,660 B2
(45) Date of Patent: Oct. 20, 2026

(54) PRECISION SHAPED GRAIN ABRASIVE RAIL GRINDING TOOL AND MANUFACTURING METHOD THEREFOR

(71) Applicant: 3M INNOVATIVE PROPERTIES COMPANY, St. Paul, MN (US)

(72) Inventors: Maiken Givot, St. Paul, MN (US); Michael Bartlmae, Österreich (AT); Andrea V. Kirschner, Villach (AT); Erwin Ebner, Feistritz an der Drau (AT); Walter Flaschberger, Villach (AT)

(73) Assignee: 3M Innovative Properties Company, St. Paul, MN (US)

( * ) Notice: Subject to any disclaimer, the term of this patent is extended or adjusted under 35 U.S.C. 154(b) by 785 days.

(21) Appl. No.: 17/309,753

(22) PCT Filed: Dec. 16, 2019

(86) PCT No.: PCT/IB2019/060843
§ 371 (c)(1),
(2) Date: Jun. 17, 2021

(87) PCT Pub. No.: WO2020/128781
PCT Pub. Date: Jun. 25, 2020

(65) Prior Publication Data

US 2022/0055174 A1 Feb. 24, 2022

Related U.S. Application Data

(60) Provisional application No. 62/780,959, filed on Dec. 18, 2018.

(51) Int. Cl.
*B24B 19/00* (2006.01)
*B24D 3/28* (2006.01)
(Continued)

(52) U.S. Cl.
CPC ..... *B24B 19/004* (2013.01); *B24D 3/28* (2013.01); *B24D 5/04* (2013.01); *B24D 7/14* (2013.01); *B24D 18/0009* (2013.01)

(58) Field of Classification Search
CPC . B24D 3/00; B24D 3/007; B24D 3/02; B24D 3/04; B24D 3/20; B24D 3/34;
(Continued)

(56) References Cited

U.S. PATENT DOCUMENTS 3,576,090 A * 4/1971 Shoemaker ..... B24D 7/04 51/297
5,518,443 A * 5/1996 Fisher ..... B28D 1/121 451/542

(Continued)

FOREIGN PATENT DOCUMENTS

CN 201385261 1/2010
CN 201385261 Y * 1/2010

(Continued)

OTHER PUBLICATIONS

CN-201385261—Machine Translation (Year: 2010).*

(Continued)

*Primary Examiner* — Brian D Keller
*Assistant Examiner* — Alberto Saenz
(74) *Attorney, Agent, or Firm* — Martha J. Engel

(57) ABSTRACT

The present disclosure provides improved rail grinding tools. Precision-shaped grains (PSGs), such as PSGs manufactured by 3M® company, provide significant performance improvement in resin-bond and vitrified bond grinding wheels. The use of PSG improves the performance of portable bonded wheels and precision grinding wheels, such as resin bond roll grinding wheels, flute grinding wheels, vitrified gear grinding wheels, cylindrical grinding wheels, and surface grinding wheels. The formation and composi-
(Continued)

tion of (e.g., monolithic) and multiple-layer PSG grinding tools described herein provides improved performance of rail grinding tools.

14 Claims, 4 Drawing Sheets

(51) Int. Cl.
*B24D 5/04* (2006.01)
*B24D 7/14* (2006.01)
*B24D 18/00* (2006.01)

(58) Field of Classification Search
CPC ..... B24D 3/342; B24D 3/346; B24D 3/28; B24D 5/00; B24D 5/02; B24D 5/04; B24D 5/14; B24D 5/16; B24D 7/00; B24D 7/02; B24D 7/14; B24D 7/16; B24D 7/18; B24B 19/004
USPC ..... 451/548
See application file for complete search history.

(56) References Cited

U.S. PATENT DOCUMENTS

| | | | | |
|---|---|---|---|---|
| 5,942,015 | A * | 8/1999 | Culler | B24D 18/00 51/297 |
| 6,309,282 | B1 * | 10/2001 | Wright | B24B 37/24 451/41 |
| 9,180,573 | B2 | 11/2015 | Givot | |
| 9,573,250 | B2 | 2/2017 | Schwabel | |
| 2006/0079159 | A1 * | 4/2006 | Naujok | B24D 7/14 451/526 |
| 2013/0040537 | A1 | 2/2013 | Schwabel | |
| 2013/0203328 | A1 | 8/2013 | Givot | |

FOREIGN PATENT DOCUMENTS

| | | | | | |
|---|---|---|---|---|---|
| CN | 101774159 | | | 7/2010 | |
| CN | 203680091 | U | | 7/2014 | |
| CN | 107234549 | A | * | 10/2017 | B24D 3/04 |
| JP | 11188637 | A | | 7/1999 | |
| JP | 3004169 | | | 1/2000 | |
| JP | 2008114350 | A | * | 5/2008 | |
| KR | 20120004615 | U | * | 6/2012 | |
| WO | WO 2011-109188 | | | 9/2011 | |
| WO | WO 2011-139562 | | | 11/2011 | |
| WO | WO 2018-049204 | | | 3/2018 | |
| WO | WO-2018049204 | A1 | * | 3/2018 | B24D 18/0009 |
| WO | WO 2018-080784 | | | 5/2018 | |
| WO | WO-2018080784 | A1 | * | 5/2018 | B24D 18/00 |

OTHER PUBLICATIONS

KR-20120004615—Machine Translation (Year: 2012).*
JP 2008114350—Machine Translation (Year: 2008).*
CN 107234549—Machine Translation (Year: 2017).*
International Search report for PCT International Application No. PCT/IB2019/060843 mailed on Mar. 23, 2020, 5 pages.

* cited by examiner

PRECISION SHAPED GRAIN ABRASIVE RAIL GRINDING TOOL AND MANUFACTURING METHOD THEREFOR

CROSS REFERENCE TO RELATED APPLICATIONS

This application is a national stage filing under 35 U.S.C. 371 of PCT/IB2019/060843, filed Dec. 16, 2019, which claims the benefit of U.S. Provisional Application No. 62/780,959, filed Dec. 18, 2018, the disclosure of which is incorporated by reference in its/their entirety herein.

BACKGROUND

Railroad rail grinding may be used to improve the efficiency and safety of railroad transportation. Rail grinding is typically carried out in two stages: immediately before commissioning the rail section to correct any errors, and to perform repair and maintenance after a certain period of operation. Rail grinding is typically performed in one of three ways: using grinding trains equipped with multiple grinding wheel attachments, using hand-held tools after welding operations, or using hand-guided machines over short distances for more intensive re-profiling or for smaller track parts. What is needed is an improved rail grinding solution to improve the efficiency and safety of rail grinding.

SUMMARY OF THE DISCLOSURE

The present disclosure provides improved rail grinding tools. Precision-shaped grains (PSGs), such as PSGs manufactured by 3M® company, provide significant performance improvement in resin-bond and vitrified bond grinding wheels. The use of PSG improves the performance of portable bonded wheels and precision grinding wheels, such as resin bond roll grinding wheels, flute grinding wheels, vitrified gear grinding wheels, cylindrical grinding wheels, and surface grinding wheels. The formation and composition of single-layer (e.g., monolithic) and multiple-layer PSG grinding tools described herein provides improved performance of rail grinding tools. In particular, the PSG grinding tools described herein provide improved rail material removal, improved wheel life/wear, improved speed (e.g., speed of the grinding train), reduced or eliminated grinding burn, reduced or eliminated grinding sparks and slag (e.g., problems due to cable damage and time for removal from equipment), improved acoustics and noise level reduction through more precise and accurate grinding, and reduction or elimination of track corrugation by way of effective abrasive material.

BRIEF DESCRIPTION OF THE FIGURES

The drawings illustrate generally, by way of example, but not by way of limitation, various embodiments discussed in the present document.

DETAILED DESCRIPTION

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Figure 1:
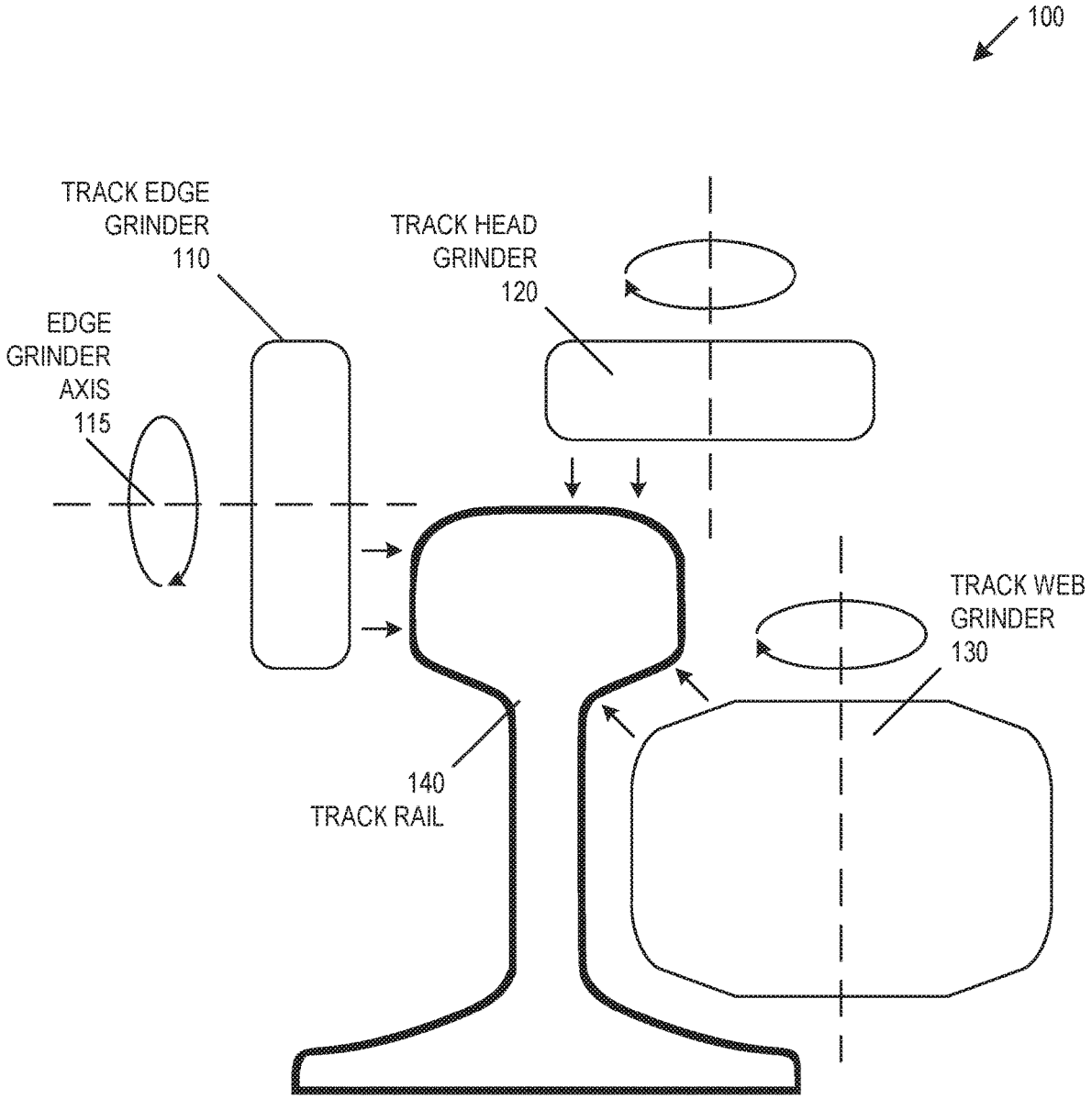
FIG. 1 is a schematic diagram of rail grinding wheels, in accordance with various embodiments.

FIG. 1 is a schematic diagram of rail grinding wheels 100, in accordance with various embodiments. The rail grinding wheels 100 may include a track edge grinder 110, a track head grinder 120, and a track web grinder 130. A portion of each of the grinding wheels 100 may be applied to a respective surface of the track rail 140. For example, the portion of the track edge grinder 110 below its axis of rotation 115 may be applied to an edge portion of the track rail 140. Various abrasive structures may be used, such as those described in ISO 603-5. For example, the grinding tool structure may include a grinding wheels for surface grinding/face grinding, a cemented or clamped cylinder wheel, a straight cup wheel, a segment (e.g., T31), a cemented or clamped disc wheel, a disc wheel with inserted nuts, a cylinder wheel with inserted nuts, or other grinding tool structure. The abrasive structures may include various combinations of abrasives and binders, such as shown and described with respect to FIGS. 2-4 below.

Figure 2A:
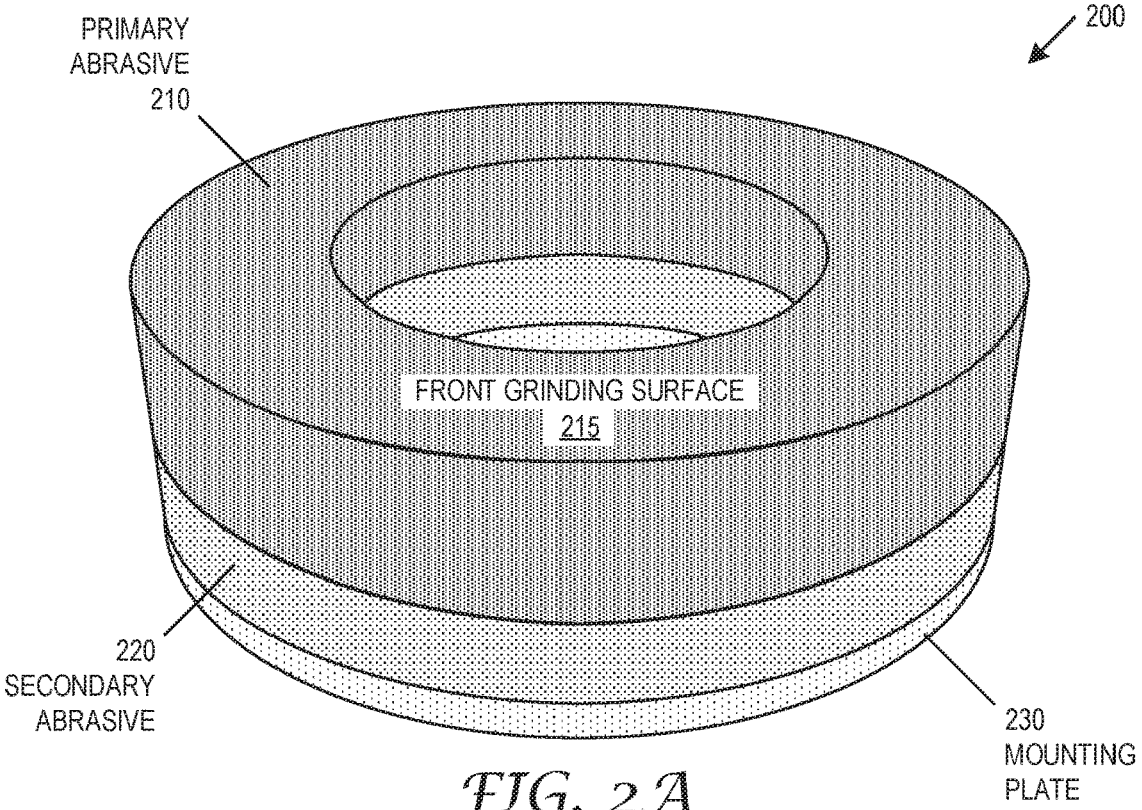
FIGS. 2A-2B are profile and perspective views of a first rail grinding wheel, in accordance with various embodiments.
Figure 2B:
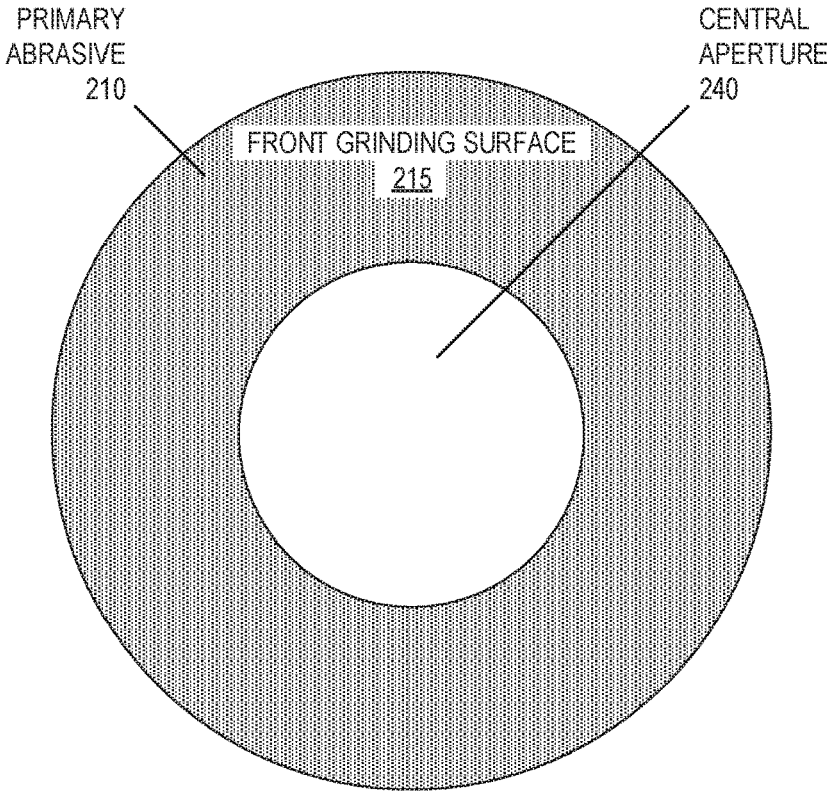

FIGS. 2A-2B are profile and perspective views of a first rail grinding wheel 200, in accordance with various embodiments. The first rail grinding wheel 200 may form a disc-shaped (e.g., discoidal) grinding wheel, such as for face grinding applications. The first rail grinding wheel 200 may include a primary abrasive portion 210 and a secondary abrasive portion 220. The primary abrasive portion 210 may define a front grinding surface 215, and may include precision-shaped grain (PSG) abrasive particles retained in a first binder. The secondary abrasive portion 220 may define a back surface opposite the front grinding surface, and may include secondary abrasive particles retained in a second binder. The primary abrasive portion 210 may be larger than the secondary abrasive portion 220. The secondary abrasive portion 220 may be bonded to the primary abrasive portion 210 to form the first rail grinding wheel 200.

The first rail grinding wheel 200 may include a central aperture 240 therein that extends from the front grinding surface through the back surface. Wheel 200 may include a rail grinding mounting plate 230. The secondary abrasive portion 220 may be affixed to the rail grinding mounting plate 230, such as by bonding (e.g., gluing), clamping, screwing, or pressing and curing the secondary abrasive portion 220 directly into the rail grinding mounting plate 230. Wheel 200 may include one or more mounting tools embedded within the secondary abrasive portion 220, such as mounting nuts, a plurality of mounting bolts, and a plurality of mounting screws.

The particles for the primary abrasive portion 210 and secondary abrasive portion 220 may be selected based on different characteristics, such as abrasive efficiency, wheel life/wear, cost, or other characteristics. For example, the PSG abrasive particles within the primary abrasive portion 210 may be selected to provide greater abrasion than the secondary abrasive particles within the secondary abrasive portion 220. Though FIG. 2 shows two abrasive portions, additional abrasive portions may be used to provide varying levels of abrasion, wheel life/wear, cost, or other considerations.

The PSG abrasive particles may include abrasive rods, abrasive triangle plates, abrasive tetrahedra, or other abrasive particles. The PSG abrasive particles may include ceramic abrasive particles. One type of ceramic abrasive may include ceramic alumina. Ceramic alumina abrasive particles may include ceramic sol-gel aluminum oxide abrasive particles, such as ceramic sol-gel alumina (blue) as disclosed by 3M® company. The ceramic alumina abrasive particles may include ceramic aluminum oxide abrasive particles, such as sintered (white) aluminum oxide particles as disclosed by 3M® company. The ceramic alumina abrasive particles may include at least one of alpha alumina, ceramic rods, and ceramic platelets. The ceramic alumina abrasive particles may be present in the primary abrasive portion 210 in an amount of at least 5% by weight.

The PSG abrasive particles may include tetrahedra, triangular pyramids, extruded abrasive particles, or other abrasive particles. The triangular pyramids may include truncated triangular pyramids, such as pyramids having a slope angle in a range of from 75 to 85 degrees. The abrasive particles may have ratio of maximum length to thickness of from 1:1 to 10:1.

The primary abrasive portion 210 may further include diluent crushed abrasive particles, where the diluent crushed abrasive particles may have a smaller mean particle size than the shaped abrasive particles. The secondary abrasive particles may include alumina-zirconia (Al2O3-ZrO2) or non-oxide materials such as nitrides (e.g., Si3N4), carbides (e.g., SiC, B4C, WC), or superabrasives (e.g., diamond, cubic boron nitride) as secondary grains. In another embodiment, the secondary abrasive portion may be substantially free of abrasive particles.

In an embodiment, the primary abrasive portion 210 and secondary abrasive portion may be formed from a combination of multiple abrasives. For example, the primary abrasive portion 210 may include approximately 55.3% wt brown fused alumna (Federation of European Producers of Abrasives (FEPA) grade F20), 23.7% wt blue PSG (e.g., grade 20+), 4.91% wt liquid resin, 15.89% wt solid resin bond, and 0.21% wt organic additive. The secondary abrasive portion may include approximately 38.74% wt brown fused alumna (grade FEPA F30), 38.74% wt brown fused alumna (grade FEPA F36), 4.48% wt liquid resin, 17.83% wt solid resin bond, and 0.20% wt organic additive. The greater concentration of higher-grade brown fused alumna and blue PSG in the primary abrasive portion 210 provides improved performance over the secondary abrasive portion.

The PSG abrasive particles may include magnetizable abrasive particles. For example, the PSG abrasive particles may include ceramic bodies, each having a respective magnetizable layer disposed thereon. The magnetizable layer may consist essentially of a metal or metal alloy, or may comprise magnetizable particles retained in a binder or inside the abrasive particles. Similarly, the secondary abrasive particles include magnetizable abrasive particles or may include non-magnetizable abrasive particles. The use of magnetizable particles in one or both of the PSG abrasive particles and secondary abrasive particles provides various advantages, such as helping with mineral orientation and increasing the bond strength. In an embodiment, a coating of inorganic particles may be applied to either or both of the PSG abrasive particles and the secondary abrasive particles, such as to provide an inorganic grinding aid.

The first binder and the second binder may be selected based on different characteristics, such as binder cure time, bond efficiency, bond life/wear, cost, or other characteristics. The first binder and the second binder may include an organic binder, a vitreous binder, or other binder. In an embodiment, the first and second binder may be selected to be the same, while the particles for the primary abrasive portion 210 and secondary abrasive portion 220 may be selected to be different materials. In another embodiment, the first and second binder may be selected to be different materials, while the particles for the primary abrasive portion 210 and secondary abrasive portion 220 may be selected to be the same. In another embodiment, the first and second binder may be selected to be the same binder material, and the particles for the primary abrasive portion 210 and secondary abrasive portion 220 may be selected to be the same particles. The first binder may be selected to be the same or different from the second binder. The first and second binders may include partially or fully cured phenolic resin or partially or fully sintered vitreous binder.

Figure 3A:
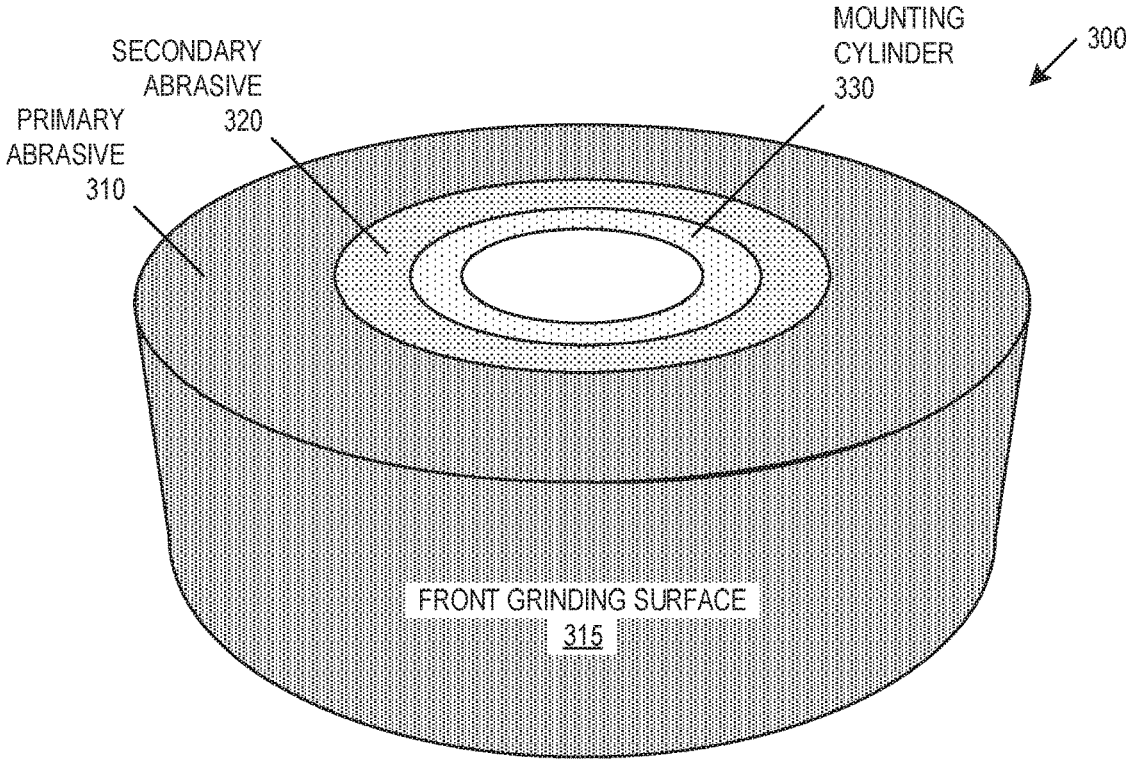
FIGS. 3A-3B are profile and perspective views of a second rail grinding wheel, in accordance with various embodiments.
Figure 3B:
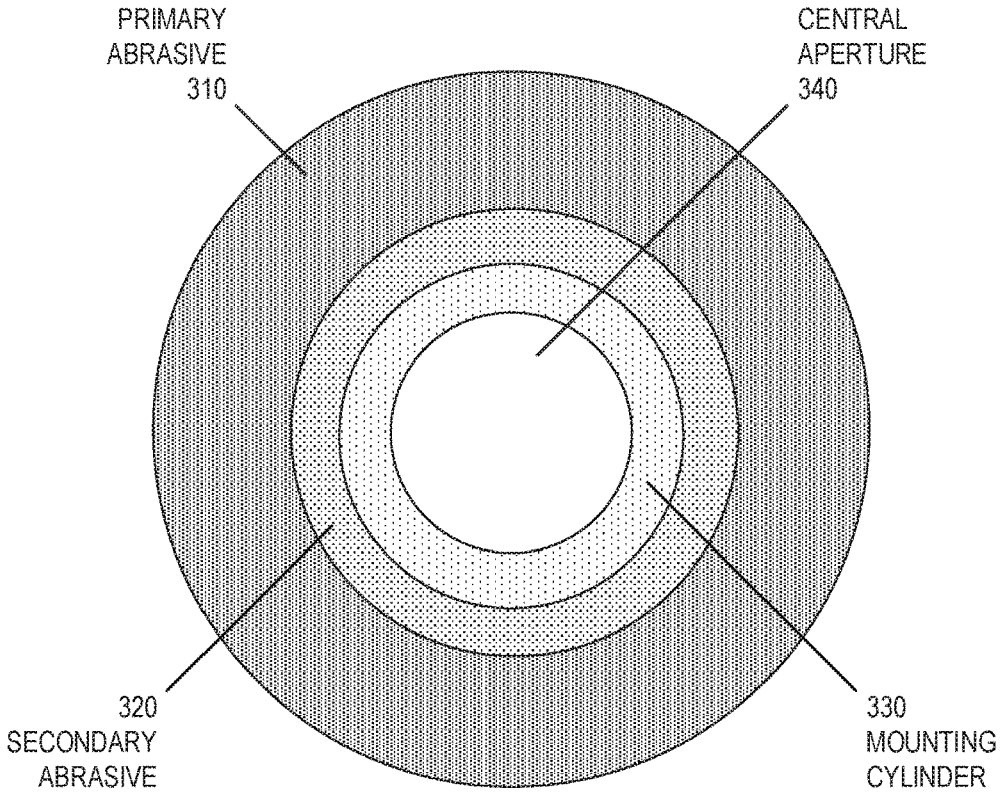

FIGS. 3A-3B are profile and perspective views of a second rail grinding wheel 300, in accordance with various embodiments. The second rail grinding wheel 300 may form a cylindrical grinding wheel. The cylindrical grinding wheel may include the primary abrasive portion 310 forming a primary grinding cylinder and the secondary abrasive portion 320 forming a secondary grinding cylinder disposed within the primary grinding cylinder. The primary abrasive portion 310 may define a front grinding surface 315, and may include PSG abrasive particles retained in a first binder. The secondary abrasive portion 320 may define a back surface opposite the front grinding surface, and may include secondary abrasive particles retained in a second binder. The secondary abrasive portion 320 may be bonded to the primary abrasive portion 310 to form the cylindrical grinding wheel. The primary abrasive portion 310 may be larger than the secondary abrasive portion 320.

The second rail grinding wheel 300 may include a rail grinding mounting cylinder 330, wherein the secondary abrasive portion 320 is further bonded to the rail grinding mounting cylinder 330. Wheel 300 may include a central aperture 340 therein that extends through the rail grinding mounting cylinder 330. Wheel 300 may include one or more mounting tools embedded within the secondary abrasive portion 320 or inserted through the central aperture.

To improve grinding efficiency, the PSG abrasive particles may be retained in the first binder in a predetermined orientation. The predetermined orientation may be selected based on the application. For example, the PSG abrasive particles may be oriented substantially parallel to a disc rotational axis of the first rail grinding wheel 200. In another example, the PSG abrasive particles may be oriented substantially perpendicular to a cylindrical rotational axis of the second rail grinding wheel 300. Multiple orientations may be used for the PSG abrasive particles. For example, the PSG abrasive particles adjacent to the wheel rotational axis in the secondary abrasive portion 320 may be aligned at an average of less than 35 degrees with respect to the wheel rotational axis, and the PSG abrasive particles adjacent to an outer circumference of the primary abrasive portion 310 may be aligned at an average angle that is from 35 and 90 degrees, inclusive, with respect to the wheel rotational axis. For an embodiment that includes a rail grinding segment, the PSG abrasive particles may be retained in the first binder substantially perpendicular to a segment grinding direction of the rail grinding segment (e.g., perpendicular to the grinding surface).

Figure 4:
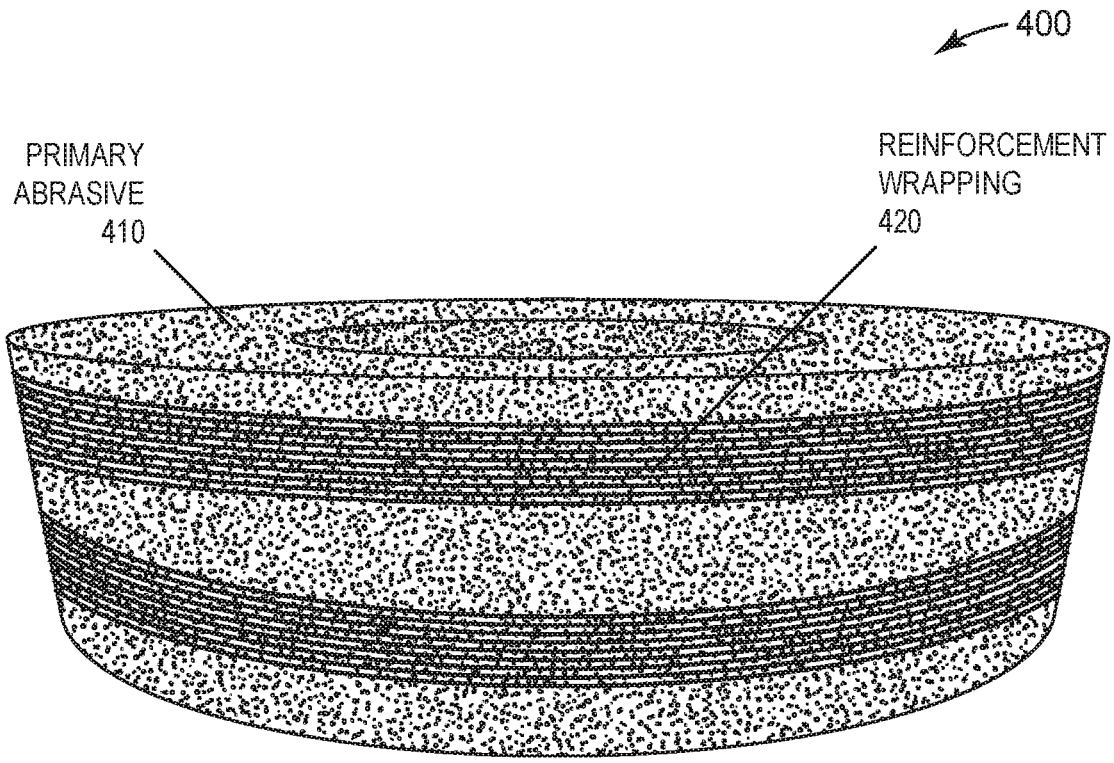
FIG. 4 is a perspective view of a reinforced rail grinding wheel, in accordance with various embodiments.

FIG. 4 is a perspective view of a reinforced rail grinding wheel 400, in accordance with various embodiments. The reinforced rail grinding wheel 400 may include at least a primary abrasive 410, and may include a secondary abrasive such as shown in FIGS. 2-3. The reinforced rail grinding wheel 400 may include a reinforcement wrapping 420 surrounding an outer wheel circumference of the reinforced rail grinding wheel 400, such as a fiber glass tape wrapping. The reinforced rail grinding wheel 400 may include one or more reinforcement substrates within the rail grinding abrasive wheel (not shown). The reinforcement wrapping 420 or reinforcement substrates may improve various properties of the reinforced rail grinding wheel 400, such as burst speed, retention of separating wheel sections (e.g., preventing high speed ejection of a portion of the wheel breaking off), and other properties.

Shaped Abrasive Particles

As used herein "shaped abrasive particle" means an abrasive particle having a predetermined or non-random shape. One process to make a shaped abrasive particle such as a shaped ceramic abrasive particle includes shaping the precursor ceramic abrasive particle in a mold having a predetermined shape to make ceramic shaped abrasive particles. Ceramic shaped abrasive particles, formed in a mold, are one species in the genus of shaped ceramic abrasive particles. Other processes to make other species of shaped ceramic abrasive particles include extruding the precursor ceramic abrasive particle through an orifice having a predetermined shape, printing the precursor ceramic abrasive particle though an opening in a printing screen having a predetermined shape, or embossing the precursor ceramic abrasive particle into a predetermined shape or pattern. In other examples, the shaped ceramic abrasive particles can be cut from a sheet into individual particles. Examples of suitable cutting methods include mechanical cutting, laser cutting, or water-jet cutting. Non-limiting examples of shaped ceramic abrasive particles include shaped abrasive particles, such as triangular plates, tetrahedral abrasive particles, elongated ceramic rods/filaments, or other shaped abrasive particles. Shaped ceramic abrasive particles are generally homogenous or substantially uniform and maintain their sintered shape without the use of a binder such as an organic or inorganic binder that bonds smaller abrasive particles into an agglomerated structure and excludes abrasive particles obtained by a crushing or comminution process that produces abrasive particles of random size and shape. In many embodiments, the shaped ceramic abrasive particles comprise a homogeneous structure of sintered alpha alumina or consist essentially of sintered alpha alumina. Any of shaped abrasive particles can include any number of shape features. The shape features can help to improve the cutting performance of any of shaped abrasive particles. Examples of suitable shape features include an opening, a concave surface, a convex surface, a groove, a ridge, a fractured surface, a low roundness factor, or a perimeter comprising one or more corner points having a sharp tip. Individual shaped abrasive particles can include any one or more of these features.

The abrasive may include conventional (e.g., crushed) abrasive particles. Examples of useful abrasive particles include fused aluminum oxide-based materials such as aluminum oxide, ceramic aluminum oxide (which can include one or more metal oxide modifiers and/or seeding or nucleating agents), alpha-alumina, fused aluminum oxide, sintered aluminum oxide, and heat-treated aluminum oxide, silicon carbide, co-fused alumina-zirconia, ceria, titanium diboride, cubic boron nitride, diamond, boron carbide, garnet, flint, emery, sol-gel derived abrasive particles, titanium diboride, boron carbide, tungsten carbide, titanium carbide, garnet, fused alumina-zirconia, sol-gel derived abrasive particle, cerium oxide, zirconium oxide, titanium oxide, and combinations thereof. The conventional abrasive particles can, for example, have an average diameter ranging from about 10 μm to about 2000 μm, about 20 μm to about 1300 μm, about 50 μm to about 1000 μm, less than, equal to, or greater than about 10 μm, 20, 30, 40, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1650, 1700, 1750, 1800, 1850, 1900, 1950, or 2000 μm. For example, the conventional abrasive particles can have an abrasives industry-specified nominal grade. Such abrasives industry-accepted grading standards include those known as the American National Standards Institute, Inc. (ANSI) standards, Federation of European Producers of Abrasive Products (FEPA) standards, and Japanese Industrial Standard (HS) standards. Exemplary ANSI grade designations (e.g., specified nominal grades) include: ANSI 12 (1842 μm), ANSI 16 (1320 μm), ANSI 20 (905 μm), ANSI 24 (728 μm), ANSI 36 (530 μm), ANSI 40 (420 μm), ANSI 50 (351 μm), ANSI 60 (264 μm), ANSI 80 (195 μm), ANSI 100 (141 μm), ANSI 120 (116 μm), ANSI 150 (93 μm), ANSI 180 (78 μm), ANSI 220 (66 μm), ANSI 240 (53 μm), ANSI 280 (44 μm), ANSI 320 (46 μm), ANSI 360 (30 μm), ANSI 400 (24 μm), and ANSI 600 (16 μm). Exemplary FEPA grade designations include P12 (1746 μm), P16 (1320 μm), P20 (984 μm), P24 (728 μm), P30 (630 μm), P36 (530 μm), P40 (420 μm), P50 (326 μm), P60 (264 μm), P80 (195 μm), P100 (156 μm), P120 (127 μm), P120 (127 μm), P150 (97 μm), P180 (78 μm), P220 (66 μm), P240 (60 μm), P280 (53 μm), P320 (46 μm), P360 (41 μm), P400 (36 μm), P500 (30 μm), P600 (26 μm), and P800 (22 μm). An approximate average particles size of reach grade is listed in parenthesis following each grade designation.

Shaped abrasive particles or crushed abrasive particles can include any suitable material or mixture of materials. For example, shaped abrasive particles can include a material chosen from an alpha-alumina, a fused aluminum oxide, a heat-treated aluminum oxide, a ceramic aluminum oxide, a sintered aluminum oxide, a silicon carbide, a titanium diboride, a boron carbide, a tungsten carbide, a titanium carbide, a cubic boron nitride, a garnet, a fused alumina-zirconia, a sol-gel derived abrasive particle, a cerium oxide, a zirconium oxide, a titanium oxide, and combinations thereof. In some embodiments, shaped abrasive particles and crushed abrasive particles can include the same materials. In further embodiments, shaped abrasive particles and crushed abrasive particles can include different materials.

Filler particles can also be included in abrasive articles or bond mixes. Examples of useful fillers include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, a hydrated aluminum compound, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, poly(vinylchloride), polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron and titanium. Other miscellaneous fillers include sulfur, organic sulfur compounds, graphite, lithium stearate and metallic sulfides. In some embodiments, individual shaped abrasive particles or individual crushed abrasive particles can be at least partially coated with an amorphous, ceramic, or organic coating. Examples of suitable components of the coatings include, a silane, glass, iron oxide, aluminum oxide, or combinations thereof. Coatings such as these can aid in processability and bonding of the particles to a resin of a binder.

Magnetic Abrasive Orientation

At least one magnetic material may be included within or coated to abrasive particles. Examples of magnetic materials include iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samarium and cobalt (e.g., $SmCo_5$); MnSb; $MnOFe_2O_3$; $Y_3Fe_5O_{12}$; $CrO_2$; MnAs; ferrites such as ferrite, magnetite; zinc ferrite; nickel ferrite; cobalt ferrite, magnesium ferrite, barium ferrite, and strontium ferrite; yttrium iron garnet; and combinations of the foregoing. In some embodiments, the magnetizable material is an alloy containing 8 to 12 weight percent aluminum, 15 to 26 wt % nickel, 5 to 24 wt % cobalt, up to 6 wt % copper, up to 1% titanium, wherein the balance of material to add up to 100 wt % is iron. In some other embodiments, a magnetizable coating can be deposited on an abrasive particle 100 using a vapor deposition technique such as, for example, physical vapor deposition (PVD) including magnetron sputtering. Including these magnetizable materials can allow shaped abrasive particles to be responsive a magnetic field. Any of shaped abrasive particles can include the same material or include different materials.

Applied magnetic fields used in practice of the present disclosure have a field strength in the region of the magnetizable particles being affected (e.g., attracted and/or oriented) of at least about 10 gauss (1 mT), at least about 100 gauss (10 mT), or at least about 1000 gauss (0.1 T), although this is not a requirement. The applied magnetic field can be provided by one or more permanent magnets and/or electromagnet(s), or a combination of magnets and ferromagnetic members, for example. Suitable permanent magnets include rare-earth magnets comprising magnetizable materials are described hereinabove. The applied magnetic field can be static or variable (e.g., oscillating). Upper or lower magnetic members may be used, each having north (N) and south (S) poles, where each magnetic member be monolithic or may be composed of multiple component magnets and/or magnetizable bodies, for example. If comprised of multiple magnets, the multiple magnets in a given magnetic member can be contiguous and/or co-aligned (e.g., at least substantially parallel) with respect to their magnetic field lines where the components magnets closest approach each other. Stainless steel retainers may be used to retain the magnets in position. While stainless steel or an equivalent is suitable due to its non-magnetic character, magnetizable materials may also be used. Mild steel mounts may be used to support stainless steel retainers. Once the magnetizable abrasive particles are dispensed onto the curable binder precursor, the binder may be cured at least partially at a first curing station (not shown), so as to firmly retain the magnetizable particles in position. In some embodiments, additional magnetizable and/or non-magnetizable particles (e.g., filler abrasive particle and/or grinding aid particles) can be applied to the make layer precursor prior to curing.

Abrasive Placement

The shaped abrasive particles described herein may have a specified z-direction rotational orientation about a z-axis passing through shaped abrasive particles, where the z-axis of the abrasive may be substantially perpendicular to the grinding direction. Shaped abrasive particles are orientated with a surface feature, such as a substantially planar surface particle, rotated into a specified angular position about the z-axis. The specified z-direction rotational orientation abrasive wheel occurs more frequently than would occur by a random z-directional rotational orientation of the surface feature due to electrostatic coating or drop coating of the shaped abrasive particles when forming the abrasive wheel. As such, by controlling the z-direction rotational orientation of a significantly large number of shaped abrasive particles, the cut rate, finish, or both of coated abrasive wheel can be varied from those manufactured using an electrostatic coating method. In various embodiments, at least 50, 51, 55, 60, 65, 70, 75, 80, 85, 90, 95, or 99 percent of shaped abrasive particles can have a specified z-direction rotational orientation which does not occur randomly and which can be substantially the same for all of the aligned particles. In other embodiments, about 50 percent of shaped abrasive particles can be aligned in a first direction and about 50 percent of shaped abrasive particles can be aligned in a second direction. In one embodiment, the first direction is substantially orthogonal to the second direction.

The specific z-direction rotational orientation of formed abrasive particles can be achieved through use of a precision apertured screen that positions shaped abrasive particles into a specific z-direction rotational orientation such that shaped abrasive particles can only fit into the precision apertured screen in a few specific orientations such as less than or equal to 4, 3, 2, or 1 orientations. For example, a rectangular opening just slightly bigger than the cross section of shaped abrasive particles comprising a rectangular plate will orient shaped abrasive particles in one of two possible 180 degree opposed z-direction rotational orientations. The precision apertured screen can be designed such that shaped abrasive particles, while positioned in the screen's apertures, can rotate about their z-axis (normal to the screen's surface when the formed abrasive particles are positioned in the aperture) less than or equal to about 30, 20, 10, 5, 2, or 1 angular degrees.

The precision apertured screen, having a plurality of apertures selected to z-directionally orient shaped abrasive particles into a pattern, may include an abrasive retainer. The abrasive retainer may include an adhesive tape on a second precision apertured screen with a matching aperture pattern, an electrostatic field used to hold the particles in the first precision screen, a mechanical lock such as two precision apertured screens with matching aperture patterns twisted in opposite directions to pinch particles within the apertures, or other retentive mechanism. The first precision aperture screen may be filled with shaped abrasive particles, and the retaining member is used to hold shaped abrasive particles in place in the apertures. In one embodiment, adhesive tape on the surface of a second precision aperture screen aligned in a stack with the first precision aperture screen causes shaped abrasive particles to be retained in the apertures of the first precision screen stuck to the surface of the tape exposed in the second precision aperture screen's apertures.

Following positioning in apertures, a coated backing having make layer may be positioned parallel to the first precision aperture screen surface containing the shaped abrasive particles with make layer facing shaped abrasive particles in the apertures. Thereafter, coated backing and the first precision aperture screen are brought into contact to adhere shaped abrasive particles to the make layer. The retaining member is released such as removing the second precision aperture screen with taped surface, untwisting the two precision aperture screens, or eliminating the electrostatic field. Then the first precision aperture screen is then removed leaving the shaped abrasive particles having a specified z-directional rotational orientation on the coated abrasive article for further conventional processing such as applying a size coat and curing the make and size coats.

Examples and Exemplary Embodiments

Various embodiments of the present disclosure can be better understood by reference to the following Examples which are offered by way of illustration. The present disclosure is not limited to the Examples given herein.

Example 1 is a rail grinding abrasive tool comprising: a primary abrasive portion defining a front grinding surface, the primary abrasive portion including precision-shaped grain abrasive particles retained in a first binder, the primary abrasive portion forming a rail grinding abrasive tool.

In Example 2, the subject matter of Example 1 optionally includes a secondary abrasive portion defining a back surface opposite the front grinding surface, the secondary abrasive portion including secondary abrasive particles retained in a second binder, the secondary abrasive portion bonded to the primary abrasive portion, the primary abrasive portion and the secondary abrasive portion forming a rail grinding abrasive wheel.

In Example 3, the subject matter of Example 2 optionally includes wherein the primary abrasive portion is larger than the secondary abrasive portion.

In Example 4, the subject matter of any one or more of Examples 2-3 optionally include wherein the rail grinding abrasive wheel includes a central aperture therein that extends from the front grinding surface through the back surface.

In Example 5, the subject matter of any one or more of Examples 2-4 optionally include a fiber glass tape wrapping surrounding an outer wheel circumference of the rail grinding abrasive wheel.

In Example 6, the subject matter of any one or more of Examples 2-5 optionally include a reinforcement substrate within the rail grinding abrasive wheel.

In Example 7, the subject matter of any one or more of Examples 2-6 optionally include a rail grinding mounting plate, wherein the secondary abrasive portion is further bonded to the rail grinding mounting plate.

In Example 8, the subject matter of any one or more of Examples 2-7 optionally include a plurality of mounting tools embedded within the secondary abrasive portion.

In Example 9, the subject matter of Example 8 optionally includes wherein the plurality of mounting tools include at least one of a plurality of mounting nuts, a plurality of mounting bolts, and a plurality of mounting screws.

In Example 10, the subject matter of any one or more of Examples 2-9 optionally include wherein the primary abrasive portion and the secondary abrasive portion form a discoidal face grinding wheel.

In Example 11, the subject matter of Example 10 optionally includes wherein the precision-shaped grain abrasive particles are retained in the first binder substantially parallel to a disc rotational axis of the discoidal face grinding wheel.

In Example 12, the subject matter of any one or more of Examples 4-11 optionally include wherein: the primary abrasive portion and the secondary abrasive portion form a cylindrical grinding wheel; the primary abrasive portion includes a primary grinding cylinder; and the secondary abrasive portion includes a secondary grinding cylinder disposed within the primary grinding cylinder.

In Example 13, the subject matter of Example 12 optionally includes wherein the precision-shaped grain abrasive particles are retained in the first binder substantially perpendicular to a cylindrical rotational axis of the cylindrical grinding wheel.

In Example 14, the subject matter of any one or more of Examples 2-13 optionally include wherein: the precision-shaped ceramic abrasive particles are retained in the first binder in a predetermined orientation with respect a wheel rotational axis of the rail grinding abrasive wheel; the precision-shaped grain abrasive particles adjacent to the wheel rotational axis in the first binder are aligned at an average of less than 35 degrees with respect to the wheel rotational axis; and the precision-shaped grain abrasive particles adjacent to an outer circumference of the primary abrasive portion are aligned at an average angle that is from 35 and 90 degrees, inclusive, with respect to the wheel rotational axis.

In Example 15, the subject matter of any one or more of Examples 1-14 optionally include wherein the primary abrasive portion and the secondary abrasive portion form a rail grinding segment.

In Example 16, the subject matter of Example 15 optionally includes wherein the precision-shaped grain abrasive particles are retained in the first binder substantially perpendicular to a segment grinding direction of the rail grinding segment.

In Example 17, the subject matter of any one or more of Examples 1-16 optionally include wherein the precision-shaped grain abrasive particles within the primary abrasive portion provide greater abrasion than the secondary abrasive particles within the secondary abrasive portion.

In Example 18, the subject matter of any one or more of Examples 1-17 optionally include wherein the first binder and the second binder include at least one of an organic binder and a vitreous binder.

In Example 19, the subject matter of any one or more of Examples 1-18 optionally include wherein the precision-shaped grain abrasive particles include at least one of abrasive rods, abrasive triangle plates, and abrasive tetrahedra.

In Example 20, the subject matter of any one or more of Examples 1-19 optionally include wherein the precision-shaped grain abrasive particles include ceramic alumina abrasive particles.

In Example 21, the subject matter of Example 20 optionally includes wherein the ceramic alumina abrasive particles include ceramic sol-gel aluminum oxide abrasive particles.

In Example 22, the subject matter of any one or more of Examples 20-21 optionally include wherein the ceramic alumina abrasive particles include sintered aluminum oxide abrasive particles.

In Example 23, the subject matter of any one or more of Examples 20-22 optionally include % by weight.

In Example 24, the subject matter of any one or more of Examples 20-23 optionally include wherein the precision-shaped grain abrasive particles include at least one of sintered aluminum oxide abrasive particles, powder-derived aluminum oxide abrasive particles, or sol-gel derived abrasive particles.

In Example 25, the subject matter of any one or more of Examples 1-24 optionally include wherein the precision-shaped grain abrasive particles include magnetizable abrasive particles.

In Example 26, the subject matter of Example 25 optionally includes wherein the precision-shaped grain abrasive particles include ceramic bodies, each having a respective magnetizable layer disposed thereon.

In Example 27, the subject matter of Example 26 optionally includes wherein the magnetizable layer consists essentially of a metal or metal alloy.

In Example 28, the subject matter of any one or more of Examples 26-27 optionally include wherein the magnetizable layer comprises magnetizable particles retained in a binder.

In Example 29, the subject matter of any one or more of Examples 26-28 optionally include wherein the ceramic bodies include at least one of alpha alumina, ceramic rods, ceramic platelets, and ceramic tetrahedra.

In Example 30, the subject matter of Example 29 optionally includes wherein the secondary abrasive particles include non-magnetizable abrasive particles.

In Example 31, the subject matter of any one or more of Examples 25-30 optionally include wherein the secondary abrasive particles include magnetizable abrasive particles.

In Example 32, the subject matter of any one or more of Examples 1-31 optionally include wherein the secondary abrasive portion is substantially free of the shaped abrasive particles.

In Example 33, the subject matter of any one or more of Examples 1-32 optionally include wherein the precision-shaped grain abrasive particles include tetrahedra.

In Example 34, the subject matter of any one or more of Examples 1-33 optionally include wherein the precision-shaped grain abrasive particles include truncated triangular pyramids.

In Example 35, the subject matter of any one or more of Examples 1-34 optionally include wherein the precision-shaped grain abrasive particles include extruded abrasive particles.

In Example 36, the subject matter of Example 35 optionally includes

In Example 37, the subject matter of any one or more of Examples 1-36 optionally include wherein at least a portion of the precision-shaped grain abrasive particles have a coating of inorganic particles thereon.

In Example 38, the subject matter of Example 37 optionally includes wherein the secondary abrasive particles include the coating of inorganic particles thereon.

In Example 39, the subject matter of Example 38 optionally includes wherein the coating of inorganic particles forms an inorganic grinding aid.

In Example 40, the subject matter of any one or more of Examples 1-39 optionally include the primary abrasive portion further including diluent crushed abrasive particles.

In Example 41, the subject matter of Example 40 optionally includes wherein the diluent crushed abrasive particles have a smaller mean particle size than the shaped abrasive particles.

In Example 42, the subject matter of any one or more of Examples 1-41 optionally include wherein the first binder and the second binder are different.

In Example 43, the subject matter of any one or more of Examples 1-42 optionally include wherein at least one of the first or second binder comprises an at least partially cured phenolic resin.

In Example 44, the subject matter of any one or more of Examples 1-43 optionally include wherein at least one of the first or second binder comprises an at least partially cured vitreous binder.

Example 45 is a method of making a rail grinding abrasive tool, the method comprising: disposing precision-shaped grain abrasive particles in a first binder, the precision-shaped grain abrasive particles and the first binder forming a primary abrasive portion with a front grinding surface, the primary abrasive portion forming a rail grinding abrasive tool.

In Example 46, the subject matter of Example 45 optionally includes disposing a secondary abrasive portion on the primary abrasive portion, the secondary abrasive portion defining a back surface opposite the front grinding surface, the secondary abrasive portion including secondary abrasive particles retained in a second binder, the secondary abrasive portion bonded to the primary abrasive portion, the primary abrasive portion and the secondary abrasive portion forming a rail grinding abrasive wheel.

In Example 47, the subject matter of Example 46 optionally includes wherein the rail grinding abrasive wheel includes a central aperture therein that extends from the front grinding surface through the back surface.

In Example 48, the subject matter of any one or more of Examples 46-47 optionally include disposing a fiber glass tape wrapping around an outer wheel circumference of the rail grinding abrasive wheel.

In Example 49, the subject matter of any one or more of Examples 46-48 optionally include disposing a reinforcement substrate within the rail grinding abrasive wheel.

In Example 50, the subject matter of any one or more of Examples 46-49 optionally include disposing the rail grinding abrasive wheel on a rail grinding mounting plate, wherein the secondary abrasive portion is further bonded to the rail grinding mounting plate.

In Example 51, the subject matter of any one or more of Examples 46-50 optionally include disposing a plurality of mounting tools embedded within the secondary abrasive portion.

In Example 52, the subject matter of Example 51 optionally includes wherein the plurality of mounting tools include at least one of a plurality of mounting nuts, a plurality of mounting bolts, and a plurality of mounting screws.

In Example 53, the subject matter of any one or more of Examples 46-52 optionally include wherein the primary abrasive portion and the secondary abrasive portion form a discoidal face grinding wheel.

In Example 54, the subject matter of Example 53 optionally includes wherein the precision-shaped grain abrasive particles are retained in the first binder substantially parallel to a disc rotational axis of the discoidal face grinding wheel.

In Example 55, the subject matter of any one or more of Examples 47-54 optionally include wherein: the primary abrasive portion and the secondary abrasive portion form a cylindrical grinding wheel; the primary abrasive portion includes a primary grinding cylinder; and the secondary abrasive portion includes a secondary grinding cylinder disposed within the primary grinding cylinder.

In Example 56, the subject matter of Example 55 optionally includes wherein the precision-shaped grain abrasive particles are retained in the first binder substantially perpendicular to a cylindrical rotational axis of the cylindrical grinding wheel.

In Example 57, the subject matter of any one or more of Examples 46-56 optionally include wherein: the precision-shaped ceramic abrasive particles are retained in the first binder in a predetermined orientation with respect a wheel rotational axis of the rail grinding abrasive wheel; the precision-shaped grain abrasive particles adjacent to the wheel rotational axis in the first binder are aligned at an average of less than 35 degrees with respect to the wheel rotational axis; and the precision-shaped grain abrasive particles adjacent to an outer circumference of the primary abrasive portion are aligned at an average angle that is from 35 and 90 degrees, inclusive, with respect to the wheel rotational axis.

In Example 58, the subject matter of any one or more of Examples 45-57 optionally include wherein the primary abrasive portion and the secondary abrasive portion form a rail grinding segment.

In Example 59, the subject matter of Example 58 optionally includes wherein the precision-shaped grain abrasive particles are retained in the first binder substantially perpendicular to a segment grinding direction of the rail grinding segment.

In Example 60, the subject matter of any one or more of Examples 45-59 optionally include wherein the precision-shaped grain abrasive particles within the primary abrasive portion provide greater abrasion than the secondary abrasive particles within the secondary abrasive portion.

In Example 61, the subject matter of any one or more of Examples 45-60 optionally include wherein the first binder and the second binder include at least one of an organic binder and a vitreous binder.

In Example 62, the subject matter of any one or more of Examples 45-61 optionally include wherein the precision-shaped grain abrasive particles include at least one of abrasive rods, abrasive triangle plates, and abrasive tetrahedra.

In Example 63, the subject matter of any one or more of Examples 45-62 optionally include wherein the precision-shaped grain abrasive particles include ceramic alumina abrasive particles.

In Example 64, the subject matter of Example 63 optionally includes wherein the ceramic alumina abrasive particles include ceramic sol-gel aluminum oxide abrasive particles.

In Example 65, the subject matter of any one or more of Examples 63-64 optionally include wherein the ceramic alumina abrasive particles include sintered aluminum oxide abrasive particles.

In Example 66, the subject matter of any one or more of Examples 63-65 optionally include % by weight.

In Example 67, the subject matter of any one or more of Examples 63-66 optionally include wherein the precision-shaped grain abrasive particles include at least one of sintered aluminum oxide abrasive particles, powder-derived aluminum oxide abrasive particles, or sol-gel derived abrasive particles.

In Example 68, the subject matter of any one or more of Examples 45-67 optionally include wherein the precision-shaped grain abrasive particles include magnetizable abrasive particles.

In Example 69, the subject matter of Example 68 optionally includes wherein the precision-shaped grain abrasive particles include ceramic bodies, each having a respective magnetizable layer disposed thereon.

In Example 70, the subject matter of Example 69 optionally includes wherein the magnetizable layer consists essentially of a metal or metal alloy.

In Example 71, the subject matter of any one or more of Examples 69-70 optionally include wherein the magnetizable layer comprises magnetizable particles retained in a binder.

In Example 72, the subject matter of any one or more of Examples 69-71 optionally include wherein the ceramic bodies include at least one of alpha alumina, ceramic rods, ceramic platelets, and ceramic tetrahedra.

In Example 73, the subject matter of Example 72 optionally includes wherein the secondary abrasive particles include non-magnetizable abrasive particles.

In Example 74, the subject matter of any one or more of Examples 68-73 optionally include wherein the secondary abrasive particles include magnetizable abrasive particles.

In Example 75, the subject matter of any one or more of Examples 45-74 optionally include wherein the secondary abrasive portion is substantially free of the shaped abrasive particles.

In Example 76, the subject matter of any one or more of Examples 45-75 optionally include wherein the precision-shaped grain abrasive particles include tetrahedra.

In Example 77, the subject matter of any one or more of Examples 45-76 optionally include wherein the precision-shaped grain abrasive particles include truncated triangular pyramids.

In Example 78, the subject matter of any one or more of Examples 45-77 optionally include wherein the precision-shaped grain abrasive particles include extruded abrasive particles.

In Example 79, the subject matter of Example 78 optionally includes

In Example 80, the subject matter of any one or more of Examples 45-79 optionally include wherein at least a portion of the precision-shaped grain abrasive particles have a coating of inorganic particles thereon.

In Example 81, the subject matter of Example 80 optionally includes wherein the secondary abrasive particles include the coating of inorganic particles thereon.

In Example 82, the subject matter of Example 81 optionally includes wherein the coating of inorganic particles forms an inorganic grinding aid.

In Example 83, the subject matter of any one or more of Examples 45-82 optionally include the primary abrasive portion further including diluent crushed abrasive particles.

In Example 84, the subject matter of Example 83 optionally includes wherein the diluent crushed abrasive particles have a smaller mean particle size than the shaped abrasive particles.

In Example 85, the subject matter of any one or more of Examples 45-84 optionally include wherein the first binder and the second binder are different.

In Example 86, the subject matter of any one or more of Examples 45-85 optionally include wherein at least one of the first or second binder comprises an at least partially cured phenolic resin.

In Example 87, the subject matter of any one or more of Examples 45-86 optionally include wherein at least one of the first or second binder comprises an at least partially cured vitreous binder.

Example 88 is one or more machine-readable medium including instructions, which when executed by a computing system, cause the computing system to perform any of the methods of Examples 45-87.

Example 89 is an apparatus comprising means for performing any of the methods of Examples 45-87.

Example 90 is a machine-readable storage medium comprising a plurality of instructions that, when executed with a processor of a device, cause the device to dispose precision-shaped grain abrasive particles in a first binder, the precision-shaped grain abrasive particles and the first binder forming a primary abrasive portion with a front grinding surface, the primary abrasive portion forming a rail grinding abrasive tool.

Example 91 is an apparatus comprising means for disposing precision-shaped grain abrasive particles in a first binder, the precision-shaped grain abrasive particles and the first binder forming a primary abrasive portion with a front grinding surface, the primary abrasive portion forming a rail grinding abrasive tool.

Example 92 is one or more machine-readable medium including instructions, which when executed by a machine, cause the machine to perform operations of any of the operations of Examples 1-91.

Example 93 is an apparatus comprising means for performing any of the operations of Examples 1-92.

Example 94 is a system to perform the operations of any of the Examples 1-92.

Example 95 is a method to perform the operations of any of the Examples 1-92.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present disclosure. Thus, it should be understood that although the present disclosure has been specifically disclosed by specific embodiments and optional features, modification and variation of the concepts herein disclosed may be resorted to by those of ordinary skill in the art, and that such modifications and variations are considered to be within the scope of embodiments of the present disclosure.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section. The term "about" as used herein can allow for a degree of variability in a value or range, for example, within 10%, within 5%, or within 1% of a stated value or of a stated limit of a range, and includes the exact stated value or range. The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

In the methods described herein, the acts can be carried out in any order without departing from the principles of the disclosure, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

What is claimed is:

1. A rail grinding abrasive assembly comprising:

a rail grinding mounting plate;

a track head grinder, configured to engage a first surface of a track rail, a track web grinder configured to engage a second surface of the track rail, and a track edge grinder configured to engage a third surface of the track rail, wherein one of the track head grinder, the track web grinder or the track edge grinder comprise:

a primary abrasive portion defining a front grinding surface, the primary abrasive portion including primary precision-shaped grain abrasive particles retained in a first binder, a secondary abrasive portion comprising secondary precision-shaped grain abrasive particles retained in a second binder, the secondary abrasive portion bonded to the primary abrasive portion, wherein the secondary precision-shaped grain abrasive particles differ from the primary precision-shaped abrasive grain abrasive particles; and wherein the primary abrasive portion and the secondary abrasive portion form a single cylindrical rail grinding wheel;

the primary abrasive portion comprises a primary grinding cylinder;

the secondary abrasive portion comprises a secondary grinding cylinder disposed within the primary grinding cylinder;

wherein the secondary abrasive portion comprises one or more mounting tools embedded within the secondary abrasive portion, said mounting tools selected from mounting nuts, mounting bolts, or mounting screws, said mounting tools coupling the secondary portion to the rail grinding mounting plate;

the secondary precision-shaped grain abrasive particles adjacent to a wheel rotational axis in the secondary abrasive portion having an average alignment of less than 35 degrees with respect to the wheel rotational axis, and the primary precision-shaped grain abrasive particles adjacent to an outer circumference of the primary abrasive portion having an average alignment angle that is from 35 and 90 degrees, inclusive, with respect to the wheel rotational axis.

2. The rail grinding abrasive assembly of claim 1, wherein the primary abrasive portion is larger than the secondary abrasive portion.

3. The rail grinding abrasive assembly of claim 1, wherein the rail grinding abrasive wheel includes a rail grinding mounting cylinder and further includes central aperture therein that extends through the rail grinding mounting cylinder.

4. The rail grinding abrasive assembly of claim 1, further including a fiber glass tape wrapping surrounding an outer wheel circumference of the rail grinding abrasive wheel.

5. The rail grinding abrasive assembly of claim 1, wherein the primary abrasive portion and the secondary abrasive portion form a discoidal face grinding wheel.

6. The rail grinding abrasive assembly of claim 1, wherein:

the primary precision-shaped grain abrasive particles are retained in the first binder in a predetermined orientation with respect a wheel rotational axis of the rail grinding abrasive wheel;

the primary precision-shaped grain abrasive particles adjacent to the wheel rotational axis in the first binder are aligned at an average angle of less than 35 degrees with respect to the wheel rotational axis.

7. The rail grinding abrasive assembly of claim 1, wherein the primary or secondary precision-shaped grain abrasive particles include magnetizable abrasive particles.

8. The rail grinding abrasive assembly of claim 1, wherein the primary abrasive portion has a first material removal rate, the secondary abrasive portion has a second material removal rate, and wherein the first material rate is higher than the second material removal rate.

9. The rail grinding abrasive assembly of claim 1, wherein the primary precision-shaped grain abrasive particles have a first average abrasive particle grade, the secondary precision-shaped grain abrasive particles have a second average abrasive particle grade, wherein the first average abrasive particle grade is higher than the second average abrasive particle grade.

10. The rail grinding abrasive assembly of claim 1, wherein the primary abrasive portion comprises a first concentration of the primary precision-shaped grain abrasive particles, wherein the secondary abrasive portion comprises a second concentration of the secondary precision-shaped grain abrasive particles, wherein the first concentration is higher than the second concentration.

11. The rail grinding abrasive assembly of claim 1, wherein the primary precision-shaped grain abrasive particles comprise abrasive particles having a first abrasive particle composition, wherein the secondary precision-shaped grain abrasive particles comprise abrasive particles having a second abrasive particle composition, wherein the first abrasive particle composition differs from the second abrasive particle composition.

12. A method of grinding a rail, the method comprising:

providing the rail grinding abrasive assembly of claim 1;

rotating the cylindrical rail grinding wheel about an axis; and bringing the cylindrical rail grinding wheel into frictional contact with a surface of the rail.

13. A method of making a rail grinding abrasive tool, the method comprising:

disposing primary precision-shaped grain abrasive particles in a first binder, the primary precision-shaped grain abrasive particles having a first average abrasive grade, the primary precision-shaped grain abrasive particles and the first binder forming a primary abrasive portion with a front grinding surface;

disposing secondary precision-shaped grain abrasive particles in a second binder, the secondary precision-shaped grain abrasive particles comprising a second average abrasive grade, the second average abrasive grade being lower than the first average abrasive grade; the secondary precision shaped grain abrasive particles and the second binder forming a secondary abrasive portion, wherein the primary abrasive portion and the secondary abrasive portion form a single cylindrical rail grinding wheel, the primary abrasive portion comprising a primary grinding cylinder, and the secondary abrasive portion includes a secondary grinding cylinder disposed within the primary grinding cylinder;

disposing the rail grinding abrasive tool on a rail grinding mounting plate, wherein the secondary abrasive portion is further bonded to the rail grinding mounting plate, wherein the rail grinding abrasive wheel is a track head grinder, a track web grinder or a track edge grinder; and wherein the secondary precision-shaped grain abrasive particles adjacent to a wheel rotational axis in the secondary abrasive portion having an average alignment of less than 35 degrees with respect to the wheel rotational axis, and the primary precision-shaped abrasive particles adjacent to an outer circumference of the primary abrasive portion having an average alignment angle that is from 35 and 90 degrees, inclusive, with respect to the wheel rotational axis.

14. The method of claim 13, further including disposing a fiber glass tape wrapping around an outer wheel circumference of the rail grinding abrasive wheel.

* * * * *